US008962955B2

(12) United States Patent
Ikeda

(10) Patent No.: US 8,962,955 B2
(45) Date of Patent: Feb. 24, 2015

(54) MUSIC BOX

(71) Applicant: Akihiro Ikeda, Obu (JP)

(72) Inventor: Akihiro Ikeda, Obu (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/153,379

(22) Filed: Jan. 13, 2014

(65) Prior Publication Data

US 2014/0202303 A1 Jul. 24, 2014

(30) Foreign Application Priority Data

Jan. 22, 2013 (JP) ..... 2013-009369

(51) Int. Cl.

| | |
|---|---|
| ***G10F 1/06*** | (2006.01) |
| ***G04B 23/00*** | (2006.01) |
| ***G10F 5/06*** | (2006.01) |

(52) U.S. Cl.

CPC ..... *G10F 1/06* (2013.01); *G04B 23/005* (2013.01); *G04B 23/00* (2013.01); *G10F 5/06* (2013.01)

USPC ..... 84/97; 84/94.1; 84/95.1; 84/98

(58) Field of Classification Search

CPC ..... G10F 1/06; G10F 5/06; G04B 23/00; G04B 23/005

USPC ..... 84/97, 98, 94.1, 95.1

See application file for complete search history.

(56) References Cited

U.S. PATENT DOCUMENTS

| | | | | | |
|---|---|---|---|---|---|
| 593,762 | A | * | 11/1897 | Brachhausen | 84/98 |
| 2,557,061 | A | * | 6/1951 | Goldman | 84/94.1 |
| 2,961,911 | A | * | 11/1960 | Duncan | 84/97 |
| 3,148,576 | A | * | 9/1964 | Kunz | 84/95.1 |
| 3,225,640 | A | * | 12/1965 | Kunz | 84/95.1 |
| 3,342,499 | A | * | 9/1967 | Uneho et al. | 369/186 |
| 4,466,328 | A | * | 8/1984 | Kitamura | 84/98 |
| 4,676,135 | A | * | 6/1987 | Kitazawa et al. | 84/94.1 |
| 4,890,528 | A | * | 1/1990 | Kamijima | 84/95.2 |

(Continued)

FOREIGN PATENT DOCUMENTS

| | | | |
|---|---|---|---|
| JP | 11272267 | A | * 10/1999 |
| JP | 11272268 | A | * 10/1999 |

(Continued)

OTHER PUBLICATIONS

Japanese Official Action dated Dec. 2, 2014 received in related JP 2013-009369 together with English language translation.

*Primary Examiner* — David Warren
*Assistant Examiner* — Christina Russell
(74) *Attorney, Agent, or Firm* — Scully, Scott, Murphy & Presser, P.C.

(57) ABSTRACT

A music box includes a plurality of star wheels, a plurality of sun wheels, a drive unit, a plurality of anchoring members, a plurality of vibration valves, a rotating disk, a detection unit, and a control unit. Each of the plurality of anchoring members is configured to engage one of a plurality of protruding parts of the plurality of star wheels. The rotating disk is configured to rotate according to a rotation of an axis. The rotating disk is formed with a plurality of slits arrayed in a circumferential direction of the rotating disk. The detection unit is configured to detect a passage of one or more of the plurality of slits. The control unit is configured to control one or more of the plurality of anchoring members to disengage one of the plurality of protruding parts, based on a detection result of the detection unit.

8 Claims, 9 Drawing Sheets

(56) References Cited

U.S. PATENT DOCUMENTS

| | | | | |
|---|---|---|---|---|
| 5,498,833 | A * | 3/1996 | Huang | 84/94.1 |
| 5,955,687 | A * | 9/1999 | Miyagi et al. | 84/97 |
| 5,973,240 | A * | 10/1999 | Isaka | 84/97 |
| 6,013,867 | A * | 1/2000 | Isaka | 84/97 |
| 6,300,548 | B1 * | 10/2001 | Zhu et al. | 84/94.1 |
| 7,250,565 | B2 * | 7/2007 | Hermanson et al. | 84/94.1 |
| 7,544,870 | B2 * | 6/2009 | White | 84/94.1 |
| 2004/0031370 | A1 * | 2/2004 | Ueno et al. | 84/94.1 |
| 2004/0065184 | A1 * | 4/2004 | Isaka et al. | 84/94.1 |
| 2004/0123718 | A1 * | 7/2004 | Muramatsu et al. | 84/94.1 |
| 2006/0169122 | A1 * | 8/2006 | Meng-Suen | 84/94.1 |
| 2008/0184863 | A1 * | 8/2008 | White | 84/95.1 |
| 2012/0192697 | A1 * | 8/2012 | Favre | 84/95.1 |
| 2014/0202302 | A1 * | 7/2014 | Ikeda | 84/95.1 |
| 2014/0202303 | A1 * | 7/2014 | Ikeda | 84/98 |
| 2014/0202304 | A1 * | 7/2014 | Ikeda et al. | 84/98 |

FOREIGN PATENT DOCUMENTS

| | | | |
|---|---|---|---|
| JP | 2009116323 | A * | 5/2009 |
| JP | 2011-128348 | A | 6/2011 |
| JP | 2011128348 | A * | 6/2011 |

* cited by examiner

MUSIC BOX

CROSS REFERENCE TO RELATED APPLICATION

This application claims priority from Japanese Patent Application No. 2013009369 filed Jan. 22, 2013. The entire content of this priority application is incorporated herein by reference.

TECHNICAL FIELD

The present disclosure relates to a music box, and particularly to a music box capable of playing sounds at a precise timing.

BACKGROUND

Music boxes for playing melodies includes: a plurality of star wheels rotatably supported on a first shaft and having a plurality of protruding parts protruding radially outward; a drive gear for driving the plurality of star wheels; a vibration plate disposed along the first shaft that has a plurality of vibration valves corresponding to the plurality of star wheels; and a solenoid for each star wheel.

The solenoid is driven to control the rotation of the corresponding star wheel. By controlling the rotation of the star wheels with solenoids, the protruding parts can be selectively made to contact and pluck the corresponding vibration valves at a prescribed timing. Accordingly, the conventional music box device can play arbitrary musical pieces, without having to replace a rotating member, such as a cylinder or disc.

SUMMARY

However, in the conventional music box described above, it is difficult to control each of the star wheels to pluck the corresponding vibration valves in order to produce sounds at a precise timing. That is, any imprecision in the meshing between the star wheel and its drive gear could offset the timing at which the protruding part on the star wheel plucks the corresponding vibration valve, resulting in a disjointed melody. The inventors of the present disclosure came across this problem while conducting thorough ongoing research aimed at improving music boxes.

In view of the foregoing, it is an object of the present disclosure to provide a music box that minimizes the generation of unwanted noise.

In order to attain the above and other objects, the present disclosure provides a music box. The music box includes a plurality of star wheels, a plurality of sun wheels, a dive unit, a plurality of anchoring members, a plurality of vibration valves, a rotating disk, a detection unit, and a control unit. The plurality of star wheels is configured to rotate about a first axis. Each of the plurality of star wheels includes a plurality of protruding parts and an intermittent gear. The plurality of protruding parts protrudes outward in a radial direction of each of the plurality of star wheels. The intermittent gear is configured to rotate about the first axis. The intermittent gear includes a plurality of gear teeth extending outward in a radial direction of the intermittent gear. The plurality of sun wheels corresponds to the plurality of star wheels and is arrayed along a second axis extending parallel to the first axis. The plurality of sun wheels is fixed on the second axis and configured to rotate about the second axis. Each of the plurality of sun wheels includes a plurality of gear portions. At least one of the plurality of gear portions is configured to engage at least one of the plurality of gear teeth. The drive unit is configured to drive the first axis and the second axis. The plurality of anchoring members corresponds to the plurality of star wheels. Each of the plurality of anchoring members is configured to engage one of the plurality of protruding parts. The plurality of vibration valves is arrayed along a first direction extending parallel to the first axis, and corresponding to the plurality of star wheels. Each of the plurality of vibration valves is configured to be plucked by one of the plurality of protruding parts. The rotating disk is configured to rotate according to a rotation of the second axis. The rotating disk is formed with a plurality of slits arrayed in a circumferential direction of the rotating disk. The detection unit is configured to detect a passage of one or more of the plurality of slits. The control unit is configured to control one or more of the plurality of anchoring members to disengage one of the plurality of protruding parts of one or more of the plurality of star wheels corresponding to the one or more of the plurality of anchoring members, based on a detection result of the detection unit.

BRIEF DESCRIPTION OF THE DRAWINGS

For a more complete understanding of the present disclosure, and the objects, features, and advantages thereof, reference now is made to the following descriptions taken in connection with the accompanying drawings.

DETAILED DESCRIPTION

Figure 1:
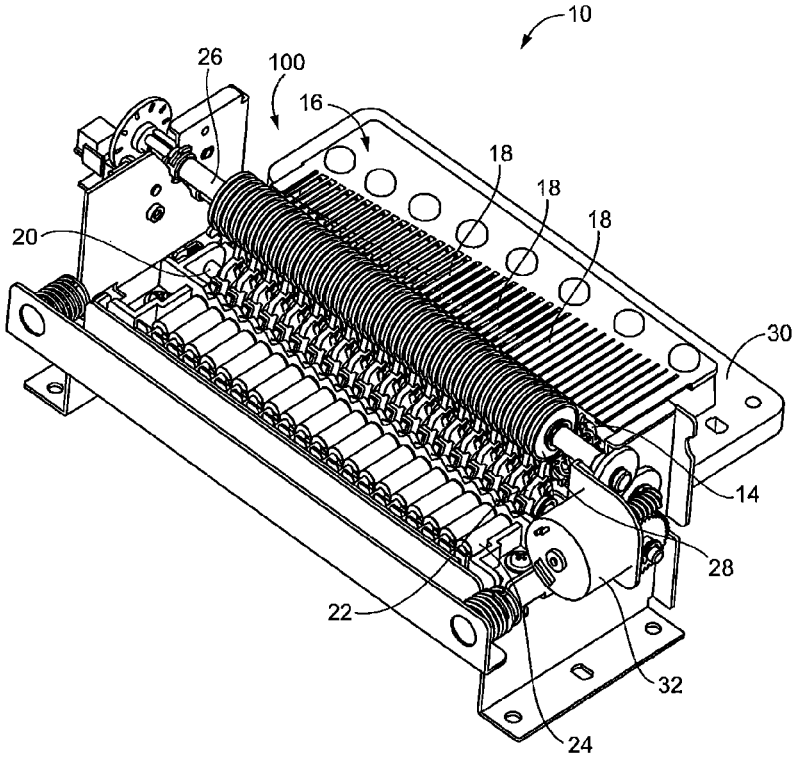
FIG. 1 is a schematic perspective view of a music box according to one or more aspects of the disclosure.

Next, a music box 10 according to a preferred disclosure will be described while referring to the accompanying drawings. FIG. 1 shows the structure of a mechanical performance unit 100 provided in the music box 10 according to the preferred embodiment. FIG. 1 is a perspective view of the mechanical performance unit 100 from obliquely above the same. In the preferred embodiment, the top of the music box 10 will be considered the uppermost portion of the music box 10 in a general vertical direction when the music box 10 is resting on a flat surface (not shown).

As shown in FIG. 1, the mechanical performance unit 100 includes a first shaft 12 (see FIG. 2 and other drawings); a plurality (forty in this example) of star wheels 14 rotatably provided on the first shaft 12; a vibration plate 16 provided alongside the first shaft 12 and each having a plurality of vibration valves 18 juxtaposed alongside the first shaft 12 at positions corresponding to the star wheels 14; a pair of third shafts 20 arranged alongside the first shaft 12, and preferably parallel to the first shaft 12; a plurality of anchoring members 22 pivotally movable about each of the third shafts 20 and provided at positions corresponding to the each of the star wheels 14; a plurality of electromagnets 24 disposed in positions corresponding to the anchoring members 22; a second shaft 26 arranged parallel to the first shaft 12; a plurality of sun wheels 28 provided around the second shaft 26 at positions corresponding to the star wheels 14 so as to rotate together with and not relative to the second shaft 26; a frame 30 rotatably supporting the first shaft 12 and the second shaft 26 about their center axes, non-rotatably supporting the third shafts 20, and serving as a mounting base for the vibration plate 16, the electromagnets 24, and the like; and a motor 32 (example of a drive unit) adapted to produce a drive force for driving the first shaft 12 and the second shaft 26 to rotate about their axes in synchronization. Each sun wheel 28 is provided with a plurality of gear teeth 40 (example of a gear portion) around the peripheral edge thereof. The vibration valves 18 correspond to discrete predetermined musical tones and produce a sound at the corresponding tone when plucked by a protruding part 36 (described later) on the corresponding star wheel 14. The mechanical performance unit 100 shown in FIG. 1 is mounted in an enclosure 34 of the music box 10 described below by assembling the frame 30 to the enclosure 34.

The torque from the output shaft of the motor 32 is preferably transferred to the first shaft 12 and the second shaft 26 through a well-known gear mechanism or the like. The first shaft 12 and the second shaft 26 should be driven to rotate at the same rotational speed (angular velocity). Specifically, the corresponding star wheel 14 and the sun wheel 28 are coupled through drive gears provided on their respective axial ends, with a suitable reduction ratio being employed so that the star wheel 14 and the sun wheel 28 rotate at the same speed when driven by output from the motor 32. Alternatively, individual motors may be provided for the first shaft 12 and the second shaft 26 and may be configured to drive the shafts to rotate at the same rotational speed.

The music box 10 is provided with a detection unit for detecting the amount of displacement in the motor 32, i.e., the amount of rotation by the output shaft. The detection unit should be provided adjacent to the sun wheel 28 and is configured of an encoder 80 (example of a detection unit) for detecting rotation of the second shaft 26. The encoder 80 is preferably a rotary encoder that detects rotation in prescribed angles corresponding to the spacing of gear teeth 40 on the sun wheel 28. The encoder 80 includes a rotating disk 82, and a timing sensor 86.

The rotating disk 82 is fixed to the second shaft 26 so as to rotate in association with the same. A plurality of slits 84 are formed in the rotating disk 82 at prescribed angular intervals in a circumferential direction thereof so as to penetrate the same in the axial direction of the second shaft 26, i.e., in a direction in which the plurality of sun wheels 28 is arranged. Each of the plurality of slits 84 corresponds to the arrangement of the gear teeth 40 on the sun wheels 28.

The timing sensor 86 detects the passing of the slits 84 in the rotating disk 82. The timing sensor 86 should be provided at a prescribed position relative to the rotating disk 82 and is preferably configured of an optical sensor that detects slits by receiving light emitted from an LED or the like provided on the opposite side of the rotating disk 82. Alternatively, the timing sensor 86 may be a magnetic sensor that detects changes in magnetic flux at prescribed angular intervals around the rotating disk 82.

Figure 15:
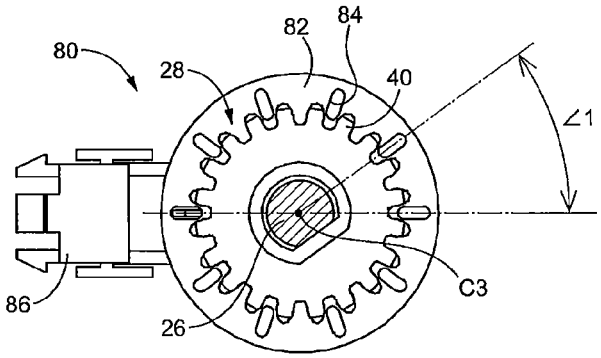
FIG. 15 is a schematic view showing a sun wheel, a rotating disk, and an encoder as viewed from the axial direction of a second shaft according to one or more aspects of the disclosure.

FIG. 15 is a view of the encoder 80 along the axial direction of the second shaft 26 illustrating the positional relationship of the sun wheel 28 fixed to the second shaft 26 and the rotating disk 82.

In the example of FIG. 15, the sun wheel 28 has twenty gear teeth 40 arranged around its periphery such that the angle between neighboring teeth is 18 degrees. Ten of the slits 84 are formed in the rotating disk 82 such that an angle $\angle 1$ between neighboring slits 84 (an angle centered on the axial center C3 of the second shaft 26) is 36 degrees. Here, the number of gear teeth 40 formed on the sun wheel 28 is preferably an integer multiple of the number of slits 84 formed in the rotating disk 82. The gear teeth 40 on the sun wheel 28 have a prescribed positional relationship with the slits 84 on the rotating disk 82. In the example of FIG. 15, the slits 84 are arranged at positions corresponding to spaces between the gear teeth 40. When there are twenty gear teeth 40 and ten slits 84, one slit 84 is arranged between every set of two gear teeth 40. In other words, two gear teeth 40 are arranged between every two neighboring slits 84 formed in the rotating disk 82. The gear teeth 40 are provided at intervals around the periphery of the sun wheel 28 and enable the encoder 80 to detect an amount of rotation corresponding to the shortest length of a sound played according to melody data described later.

Figure 16:
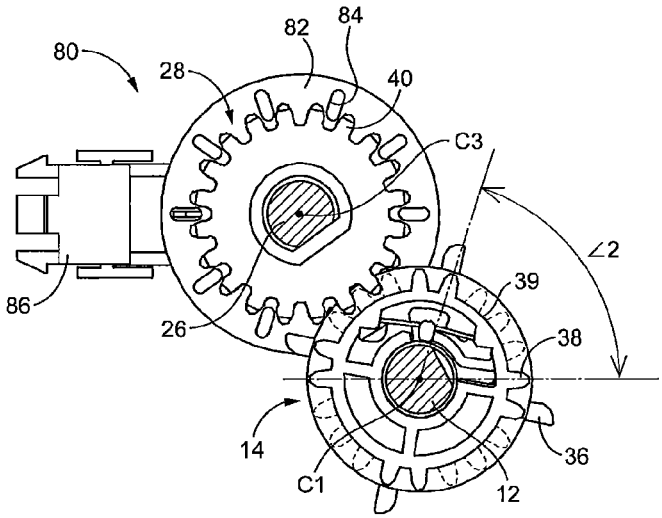
FIG. 16 is a schematic view showing the star wheel, the sun wheel, the rotating disk, and the encoder as viewed from the axial direction of the second shaft according to one or more aspects of the disclosure.

FIG. 16 is a view of the sun wheel 28 and the star wheel 14 as viewed from the axial direction of the second shaft 26 illustrating the positional relationships between the gear teeth 40 of the sun wheel 28 and an intermittent gear (example of an intermitting gear) on the star wheel 14. As shown in FIG. 16, the intermittent gear of the star wheel 14 includes gear teeth 38 provided in pairs about the periphery of the intermittent gear, and toothless portions 39 provided between each pair of gear teeth 38. Phantom gear teeth similar in size and shape to the gear teeth 38 are depicted in the toothless portions 39 with dashed lines, but are not actually present. In the example of FIG. 16, the intermittent gear of the star wheel 14 would have twenty gear teeth if the gear teeth were also provided in the toothless portions 39. Hence, the number of gear teeth that can be arranged around the intermittent gear of the star wheel 14 is preferably equal to the number of gear teeth 40 provided on the sun wheel 28 so that a prescribed number of gear teeth 40 on the sun wheel 28 can fit into each toothless portion 39 on the intermittent gear. In the example of FIG. 16, four gear teeth 40 fit in each toothless portion 39. An angle ∠2 of the second shaft 26 by lines passing through gear teeth 38 on either side of the toothless portion 39 (an angle centered on the rotational center C1 of the first shaft 12) is 72 degrees. Further, two slits 84 formed in the rotating disk 82 fit within each toothless portion 39 of the intermittent gear. In other words, the angle ∠2 corresponding to each toothless portion 39 is an integer multiple of the angle ∠1 between two neighboring slits 84 formed in the rotating disk 82, and is preferably two times the angle ∠1.

Figure 13:
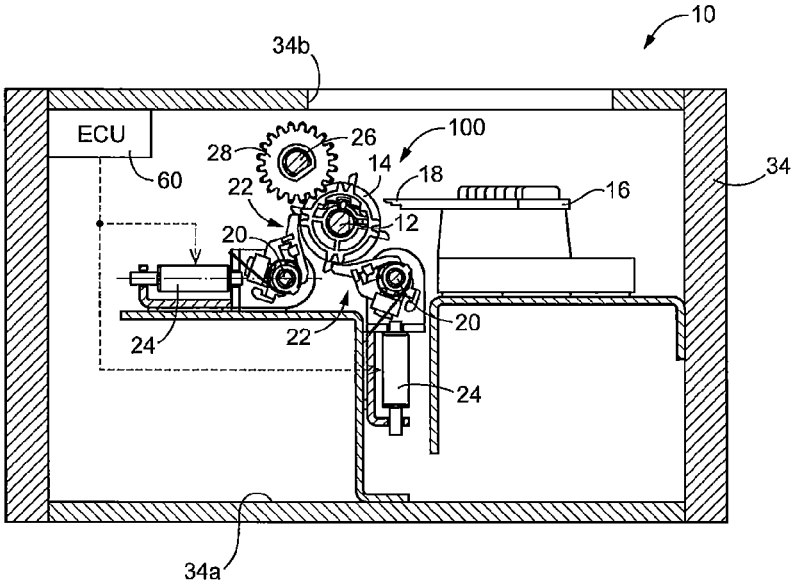
FIG. 13 is a cross-sectional view of the music box when the mechanical performance unit is accommodated in an enclosure according to one or more aspects of the disclosure.

FIG. 13 is an explanatory diagram showing the music box 10 of the preferred embodiment when the mechanical performance unit 100 of FIG. 1 is accommodated inside the enclosure 34. As shown in FIG. 13, the music box 10 is provided with the enclosure 34 for accommodating therein the components of the mechanical performance unit 100, including the first shaft 12, the star wheels 14, the vibration plate 16, the third shafts 20, the anchoring members 22, the electromagnets 24, the second shaft 26, and the sun wheels 28. That is, the mechanical performance unit 100 having the structure shown in FIG. 1 is accommodated inside the enclosure 34 by mounting the frame 30 on the enclosure 34. As shown in FIG. 13, the enclosure 34 defines an inner bottom surface 34*a*, and a viewing window 34*b*.

As indicated by a chain line in FIG. 13, the center of the third shaft 20 and at least some of the electromagnets 24 are arranged in the same plane, which is parallel to the inner bottom surface 34*a* of the enclosure 34. That is, some of the electromagnets 24 extending in horizontal direction are arranged in the plane indicated by the chain line, and remaining of the electromagnets 24 extending in vertical direction are shifted from the plane. Note that all of the electromagnets 24 may be arranged parallel to the inner bottom surface 34*a* of the enclosure 34.

The viewing window 34*b* is provided in the flat upper wall constituting the enclosure 34 to reveal the components inside the enclosure 34. The viewing window 34*b* is provided with a cover part (not shown) formed of glass or another transparent material. As shown in FIG. 13, the music box 10 also includes an electric control unit (ECU, example of a control unit) 60 adapted to control the excitation and non-excitation of each electromagnet 24.

Figure 2:
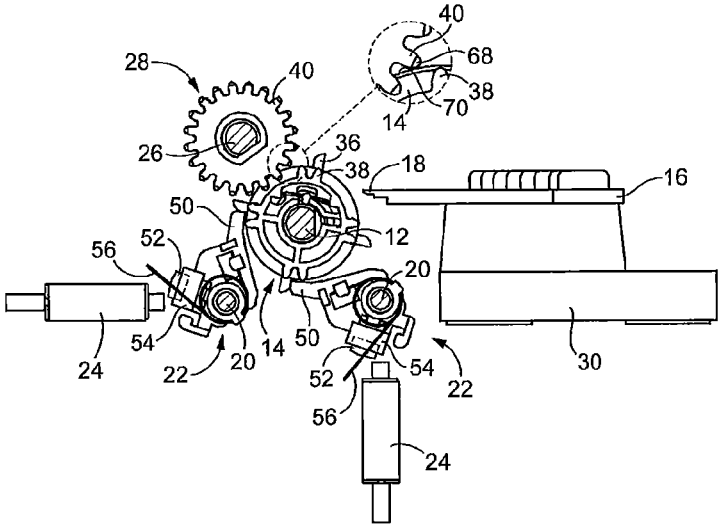
FIG. 2 is a schematic view showing a mechanical performance unit of the music box as viewed from an axial direction of a first shaft according to one or more aspects of the disclosure.
Figure 3:
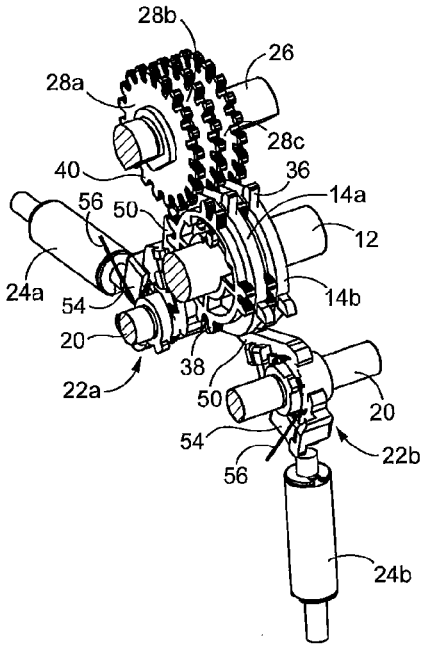
FIG. 3 is a perspective view of the mechanical performance unit shown in FIG. 2 according to one or more aspects of the disclosure.

FIG. 2 is a view of the mechanical performance unit 100 in the music box 10 along the axial direction of the first shaft 12 illustrating the structures of the star wheels 14, the anchoring members 22, the sun wheels 28, and the like. FIG. 3 is a perspective view from an angle obliquely above the mechanical performance unit 100 illustrating the structures of the star wheels 14, the anchoring members 22, the sun wheels 28, and the like. FIG. 3 shows two star wheels 14*a* and 14*b* of the plurality of star wheels 14 and two electromagnets 24*a* and 24*b* for the corresponding engaging members 22*a* and 22*b*.

In all drawings other than FIG. 3, where it is not necessary to distinguish among individual star wheels 14*a* and 14*b*, each star wheel is simply referred to using the reference numeral 14. Similarly, engaging members are simply referred to using the reference numeral 22 when it is not necessary to distinguish between individual engaging members 22*a* and 22*b*, and sun wheels are simply referred to using the reference numeral 28 when it is not necessary to distinguish among individual sun wheels 28*a*, 28*b*, and 28*c*.

The example of FIG. 3 shows the sun wheels 28*a* and 28*b* corresponding to the star wheels 14*a* and 14*b*, as well as the sun wheel 28*c* neighboring the sun wheel 28*b*. Here, a neighboring sun wheel 28 is defined as a sun wheel 28 positioned next to another sun wheel 28 along the second shaft 26. The vibration plate 16 and the frame 30 have been omitted from FIG. 3 while portions of the first shaft 12, the third shaft 20, and the second shaft 26 are also omitted (cut).

As shown in FIGS. 2 and 3, each star wheel 14 is provided with a plurality of protruding parts 36 that protrude radially outward from the peripheral edge thereof. Preferably, four of the protruding parts 36 are provided equidistantly, i.e., at every 90 degrees, around the periphery of the star wheel 14. A plurality of gear teeth 38 are formed at a position radially inside of the protruding parts 36 and protrudes outward. More specifically, the star wheel 14 is provided with the intermittent gear having the gear teeth 38, and the toothless portions 39 (see FIG. 16) that do not engage with gear teeth on the corresponding sun wheel 28, as described above. Preferably two of the gear teeth 38 are provided at positions corresponding to each protruding part 36. The gear teeth 38 are arranged between adjacent star wheels 14 in the first shaft 12 and, hence, are disposed at different positions from the protruding parts 36 with respect to the axial direction of the first shaft 12. In other words, the gear teeth 38 are positioned between pairs of neighboring protruding parts 36 with respect to the axial direction of the first shaft 12.

When a star wheel 14 is assembled on the first shaft 12 as shown in FIG. 2, the protruding parts 36 are disposed at positions for contacting at least a portion of the vibration valve 18 aligned with the rotational path of the protruding parts 36 when the star wheel 14 rotates about the first shaft 12. Further, the positions of the protruding parts 36 are disposed at positions such that the corresponding the anchoring member 22 can engage the protruding parts 36 in an anchoring state described later. That is, when the anchoring member 22 contacts one of the protruding parts 36, the star wheel 14 is prevented from following the rotation of the first shaft 12. By contacting the protruding part 36 after the protruding part 36 has plucked the corresponding vibration valve 18 on the vibration plate 16, the anchoring member 22 functions as a stopper for preventing the star wheel 14 from continuing to follow the rotation of the first shaft 12. The rotational path of the gear teeth 38 about the axial center of the first shaft 12 is aligned with the corresponding sun wheel 28 so that the gear teeth 38 can engage with the gear teeth 40 provided on the sun wheel 28.

As illustrated in the enlarged view of FIG. 2 (the portion encircled by a dashed line), chamfered edges 68 are formed on the gear teeth 40 of the sun wheel 28. The chamfered edges 68 are formed on the distal ends of the gear teeth 40 and preferably on both sides in the axial direction of the sun wheel 28. Chamfered edges 70 (see FIG. 4) are formed on the outer circumferential edges of the star wheels 14. Specifically, the star wheel 68 defines an outer circumferential surface 72 formed with the chamfered edges 70. The outer edges of the star wheel 14 are the two edges relative to the axial direction on the outer circumferential surface 72 of the star wheel 14.

As the sun wheel 28 and star wheel 14 rotate, the edges of the gear teeth 40 in the axial direction of the sun wheel 28 may overlap the edges of the circumferential surface 72 on the star wheel 14. Providing the chamfered edges 68 and chamfered edges 70 allows the gear teeth 40 to enter smoothly along the side of the star wheel 14 without interference from the circumferential surface 72 or the like. This construction effectively reduces the occurrence of impact noise.

At least one of the chamfered edges 68 on the sun wheel 28 and the chamfered edges 70 on the star wheel 14 may be formed. In addition to the chamfered edges 70 formed in the circumferential surface 72 of the star wheel 14, chamfered edges may be formed in the edges of the protruding parts 36 (both axial edges) and the like. However, it is not mandatory to provide the chamfered edges 68 and chamfered edges 70 on the sun wheels 28 and star wheels 14, respectively.

Figure 4:
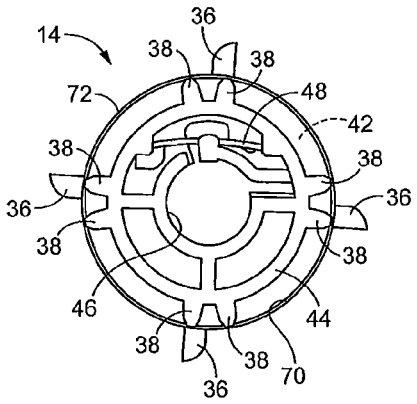
FIG. 4 is a front view of a star wheel provided in the music box as viewed from an axial direction thereof according to one or more aspects of the disclosure.

FIG. 4 is a front view of the star wheel 14 taken along the axial direction thereof to illustrate the structure of the star wheel 14 in greater detail. As shown in FIG. 4, the star wheel 14 preferably has a metal plate part 42 provided with the plurality of protruding parts 36 protruding radially outward therefrom. The metal plate part 42 is provided in a synthetic resin part 44 formed of an engineering plastic or other synthetic resin material through a process called insert molding. Insert molding is a method of integrally molding a metal member and a synthetic resin member by injecting the synthetic resin material around the metal member that has been pre-inserted inside a metal die (the same method is used for other cases of insert molding described below). The synthetic resin part 44 preferably covers all portions of the metal plate part 42, excluding the protruding parts 36. The gear teeth 38 are resinous gear parts that are preferably configured as part of the synthetic resin part 44. As a result, the positional relationships of the protruding parts 36 and the gear teeth 38 can be maintained, even when a strong external force is applied to the protruding parts 36.

The synthetic resin part 44 has a center region formed with an assembly hole 46. The synthetic resin part 44 is assembled on the first shaft 12 by inserting the first shaft 12 through the assembly hole 46. This construction reduces the occurrence of chattering when the star wheel 14 contacts the corresponding sun wheel 28. The star wheel 14 is configured so that when assembled on the first shaft 12, a prescribed frictional force acts between the inner peripheral surface of the assembly hole 46 and the outer peripheral surface of the first shaft 12. Specifically, as shown in FIG. 4, the star wheel 14 is preferably provided with a friction spring 48 for producing a frictional force between the inner peripheral surface of the assembly hole 46 and the outer peripheral surface of the first shaft 12. Since both the friction spring 48 and the first shaft 12 are formed of metal, the members could wear if they were to come into contact. However, since the friction spring 48 applies pressure to the first shaft 12 through the synthetic resin part 44 in the preferred embodiment, wear of the friction spring 48 and first shaft 12 can be suppressed. The friction spring 48 is preferably piano wire that is deformed such that its restoring force pushes the inner peripheral surface of the assembly hole 46 against the outer peripheral surface of the first shaft 12. The frictional force produced by the friction spring 48 is stronger than the force acting to rotate the star wheel 14 and weaker than the force for disengaging the star wheel 14 from the anchoring member 22. With this configuration, the star wheel 14 is mounted on the first shaft 12 and can rotate about the same.

When the anchoring member 22 is in a non-anchoring state described later, the frictional force generated at the area of contact between the star wheel 14 and the first shaft 12 causes the star wheel 14 to rotate along with the first shaft 12. If the frictional force generated by the friction spring 48 is weaker than the force for rotating the star wheel 14, there is a danger that the star wheel 14 will spin out (i.e., slide over rather than rotate together with the first shaft 12) when disengaged from the anchoring member 22. Conversely, if the frictional force is stronger than the force required to extract the star wheel 14 from the anchoring member 22 while the anchoring member 22 is in the anchored state, there is a danger that the star wheel 14 will force a plate member 50 (described later) of the anchoring member 22 to move leftward in FIG. 5 and inadvertently disengage from the anchoring member 22.

As shown in FIG. 2, the anchoring member 22 includes a plate member 50, a magnetic member 52, a synthetic resin member 54, a torsion coil spring 56, and a concave part 74. The plate member 50 is made to contact at least one protruding part 36 on the corresponding star wheel 14 by rotating the anchoring member 22 toward the star wheel 14 about the third shaft 20. The magnetic member 52 reacts to the magnetic force of the electromagnet 24 so as to rotate the anchoring member 22 in a direction for separating the anchoring member 22 from the star wheel 14. The magnetic member 52 is formed of metal whose primary component is an iron group element, such as iron, cobalt, or nickel. The magnetic member 52 is preferably an iron sheet that is not necessarily magnetized, but may be a permanent magnet (which is magnetized). The magnetic member 52 is formed in the synthetic resin member 54 through insert molding. In other words, the magnetic member 52 is embedded in the synthetic resin member 54. The synthetic resin member 54 is formed of an engineering plastic or the like provided integrally with the plate member 50. This construction can reduce chattering in the magnetic member 52 caused by the attraction of the electromagnet 24. The torsion coil spring 56 urges the anchoring member 22 to rotate toward the star wheel 14.

The electromagnet 24 is preferably configured of a cylindrical coil disposed around an iron core or other magnetic material. When a current is supplied to the coil, the electromagnet 24 enters an excitation state in which a magnetic force (magnetic field) is produced. When a current is not flowing through the coil, the electromagnet 24 remains in a non-excitation state. In other words, the electromagnet 24 is a common electromagnet known in the art.

As shown in FIG. 2, the electromagnet 24 is provided for each of the anchoring members 22. The electromagnet 24 is positioned near the synthetic resin member 54 of the anchoring member 22 having the embedded magnetic member 52, but is separated from the magnetic member 52 so as not to contact the same. In other words, the electromagnet 24 and the anchoring member 22 do not contact each other when in their closest state. That is, a prescribed gap is formed between the magnetic member 52 and the electromagnet 24 whether the anchoring member 22 is in an anchoring state or a non-anchoring state described later. This gap should fall within a range in which the magnetic force of the electromagnet 24 can affect the magnetic member 52 when the electromagnet 24 is excited. For example, the gap should be designed such that the magnetic force of the excited electromagnet 24 will attract the magnetic member 52, even when the electromagnet 24 and the anchoring member 22 are in their furthest separated state.

Moreover, the gap should be set such that the attracting force of the electromagnet 24 can rotate the anchoring member 22 in a direction away from the star wheel 14. As indicated by the chain line in FIG. 8, the axial center of the electromagnet 24 (central axis of the iron core) is configured to intersect the rotational center of the anchoring member 22 (i.e., the axial center of the third shaft 20), as will be described later.

The torsion coil spring 56 preferably urges the anchoring member 22 and the plate member 50 toward the star wheel 14 when the electromagnet 24 is in the non-excitation state. The plate member 50 is an anchoring state (see FIG. 6 described later) for anchoring at least one of the protruding parts 36 provided on the corresponding star wheel 14. The protruding part 36 of the star wheel 14 is halted at a standby position when the plate member 50 is in the anchoring state. However, when the electromagnet 24 is in the excitation state, the magnetic force of the electromagnet 24 causes the anchoring member 22 and the plate member 50 to rotate about the third shaft 20 in a direction away from the star wheel 14 against the urging force of the torsion coil spring 56. The anchoring member 22 comes to a halt at a position in which the force of attraction on the magnetic member 52 corresponding to the magnetic force of the electromagnet 24 is counterbalanced by the urging force of the torsion coil spring 56. In this position, the anchoring member 22 is in the non-anchoring state (see FIGS. 7 through 9 described later) in which the plate member 50 no longer anchors the protruding part 36. In the non-anchoring state, the anchor of the anchoring member 22 the star wheel 14 is released.

As illustrated in FIGS. 2 and 3, the electromagnets 24 and the anchoring members 22 corresponding to these electromagnets 24 belong to either a first group or a second group. The electromagnets 24 and the anchoring members 22 belonging to the first group are arranged at a 90-degree phase differential about the axial center of the first shaft 12 (at a position for forming an angle of 90 degrees) with the electromagnets 24 and the anchoring members 22 belonging to the second group. If the electromagnets 24 were numbered from 1 to n from one end of the third shafts 20 to the other, the electromagnets 24 with odd numbers preferably belong to the first group while those with even numbers preferably belong to the second group. Thus, the electromagnets 24, such as the electromagnets 24*a* and 24*b* in FIG. 3 corresponding to the pair of adjacent star wheels 14*a* and 14*b*, are preferably arranged apart from each other by a phase of 90 degrees about the axial center of the first shaft 12. This configuration minimizes the space required for arranging the mechanical performance unit 100 (and particularly the electromagnets 24) in the music box 10, thereby reducing the size of the music box 10.

Figure 5:
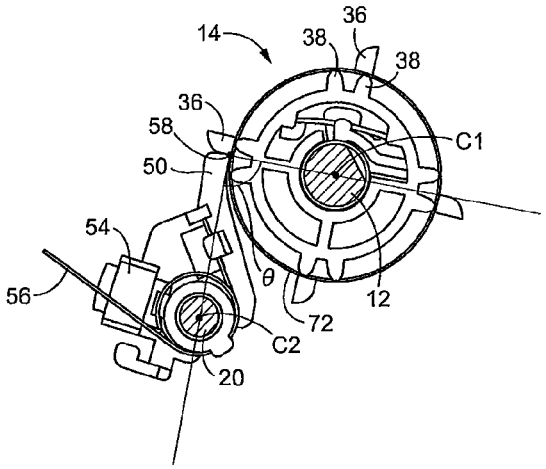
FIG. 5 is a schematic view illustrating a positional relationship between the star wheel and an anchoring member when the anchoring member is in an anchoring state according to one or more aspects of the disclosure.

FIG. 5 shows an example of the positional relationship between the anchoring member 22 and the corresponding star wheel 14 when the anchoring member 22 is in the anchoring state. When the anchoring member 22 is in this state, the angle θ formed by a straight line passing through a contact part 58 at which the protruding part 36 contacts the plate member 50 of the anchoring member 22 and a rotational center C1 of the star wheel 14, and a straight line passing through the contact part 58 and a rotational center C2 of the anchoring member 22 is preferably within a prescribed range near a right angle (90 degrees). This prescribed range is 90±10 degrees, for example. When the angle θ is smaller than this prescribed angular range, the anchoring member 22 can more easily disengage from the protruding part 36 and, hence, cannot as easily anchor the star wheel 14. When the angle θ is greater than the prescribed angular range, a relatively large force is necessary to disengage the anchoring member 22 from the protruding part 36 and, hence, the anchoring member 22 does not disengage easily. However, when the angle θ is within the prescribed angular range, the anchoring member 22 is restrained from disengaging when the electromagnet 24 is in the non-excitation state and can be suitably disengaged when the electromagnet 24 is shifted to the excitation state.

FIGS. 6 through 12 detail the operations of the mechanical performance unit 100 having the structure described above. When the music box 10 is playing a melody, the first shaft 12 and the second shaft 26 are constantly and synchronously driven by the motor 32 to rotate about their axial centers. As indicated by arrows in the drawings, the first shaft 12 and the second shaft 26 are driven to rotate in opposite directions. The first shaft 12 is preferably rotated such that the protruding parts 36 provided on the star wheel 14 move in a direction for plucking the corresponding vibration valves 18 of the corresponding vibration plate 16 upward. The second shaft 26 is rotated so that the star wheels 14 are driven to rotate in the direction indicated by the arrow when the gear teeth 38 of the star wheels 14 are engaged with the gear teeth 40 of the corresponding sun wheels 28. Since the sun wheels 28 are in capable of rotating relative to the second shaft 26, the sun wheels 28 are constantly rotated about their axial centers as the second shaft 26 rotates about its axial center while the music box 10 is playing a melody.

Figure 6:
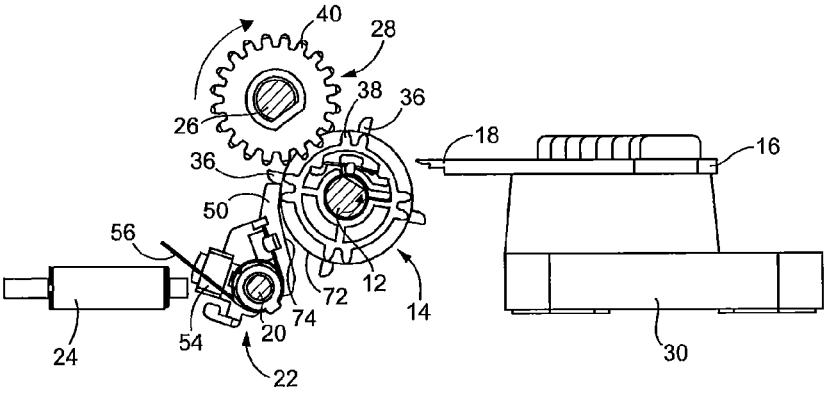
FIG. 6 is a schematic view of the mechanical performance unit when the anchoring member is in the anchoring state according to one or more aspects of the disclosure.

FIG. 6 illustrates the operations of the mechanical performance unit 100 when the anchoring member 22 is in the anchoring state. In the state shown in FIG. 6, electricity is not being supplied to the electromagnet 24 and thus the electromagnet 24 is in the non-excitation state. At this time, the torsion coil spring 56 urges the plate member 50 of the anchoring member 22 so that the anchoring member 22 is rotated toward the star wheel 14 and at least one of the protruding parts 36 on the corresponding star wheel 14 is anchored by the anchoring member 22. That is, at least one of the protruding parts 36 contacts the distal end of the plate member 50 on the downstream side with respect to the rotating direction of the first shaft 12 (the side in which the rotation progresses).

As described above, the star wheel 14 is configured to follow the rotation of the first shaft 12 through the frictional force generated at the point of contact with the first shaft 12. In the state shown in FIG. 6, the anchoring member 22 is in the anchoring state for preventing the star wheel 14 from following the rotation of the first shaft 12, despite the frictional force at the contact point. That is, the star wheel 14 positioned around the axial center of the first shaft 12 rotates relative to the first shaft 12, with the surfaces of contact between the assembly hole 46 of the star wheel 14 and the first shaft 12 sliding over each other with a light load, while the phase of the star wheel 14 (the positional relationship of the star wheel 14 relative to the vibration valve 18 and the like) remains fixed. In this state, the gear teeth 38 on the star wheel 14 are not engaged with the gear teeth 40 on the sun wheel 28 and, hence, the rotation of the sun wheel 28 does not affect the rotation of the star wheel 14. In other words, when the anchoring member 22 halts the star wheel 14 in the standby position on the first shaft 12, the gear teeth 40 of the sun wheel 28 rotate idly through the corresponding toothless portion 39 of the star wheel 14.

Figure 7:
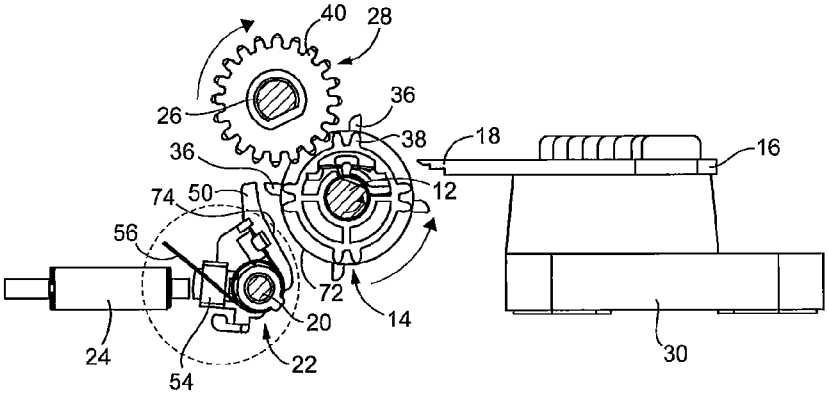
FIG. 7 is a schematic view of the mechanical performance unit when the anchoring member is shifted from the anchoring state to a non-anchoring state according to one or more aspects of the disclosure.

FIG. 7 illustrates the operations of the mechanical performance unit 100 when the anchoring member 22 is switched from the anchoring state to the non-anchoring state. When electricity is conducted to the electromagnet 24 while the mechanical performance unit 100 is in the state shown in FIG. 6, the electromagnet 24 is brought into the excitation state. The magnetic force produced by the electromagnet 24 causes the plate member 50 of the anchoring member 22 to rotate about the third shaft 20 against the urging of the torsion coil spring 56 in a direction away from the star wheel 14. Consequently, the plate member 50 that has anchored the protruding part 36 disengages therefrom, enabling the star wheel 14 to rotate together with the first shaft 12 due to the frictional force generated at the area of contact between the star wheel 14 and the first shaft 12. Immediately after electricity is conducted to the electromagnet 24 in order to disengage the protruding part 36 and the plate member 50 from the state shown in FIG. 6, the plate member 50 preferably separates from the star wheel 14, as shown in FIG. 7.

Figure 8:
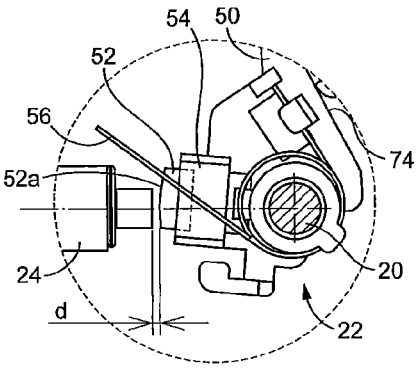
FIG. 8 is a partial enlarged view of an encircled region depicted in dotted line of FIG. 7 according to one or more aspects of the disclosure.

FIG. 8 shows an enlarged view of the area in FIG. 7 encircled by a dashed line. When the anchoring member 22 is in the non-anchoring state shown in FIG. 7, the magnetic member 52 is in the closest position to the axial center of the electromagnet 24 at the distal end thereof. In this state, the electromagnet 24 and magnetic member 52 are not in contact with each other, and a gap d exists between the two, as shown in FIG. 8. A curved surface 52*a* is preferably formed on the side of the magnetic member 52 nearest the electromagnet 24. The curved surface 52*a* has an arc shape centered on the third shaft 20. Hence, the gap d between the electromagnet 24 and magnetic member 52 will not change when the anchoring member 22 is rotated about the third shaft 20.

Figure 9:
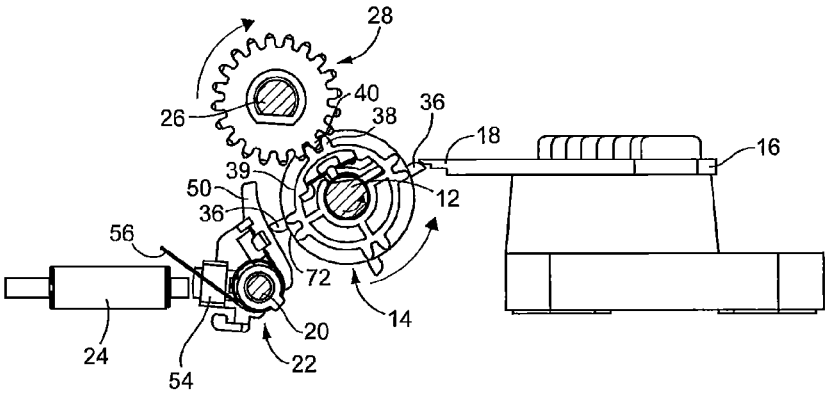
FIG. 9 is a schematic view of the mechanical performance unit when a protruding part of the star wheel plucks a vibration valve of a vibration plate according to one or more aspects of the disclosure.
Figure 10:
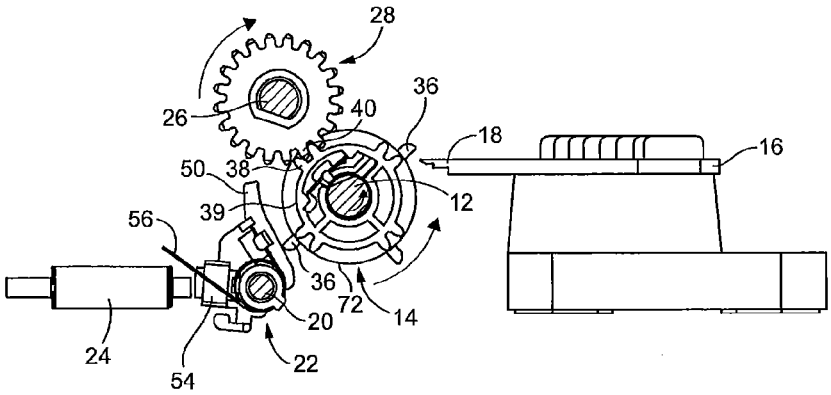
FIG. 10 is a schematic view of the mechanical performance unit when the protruding part is in sliding contact with the anchoring member according to one or more aspects of the disclosure.
Figure 11:
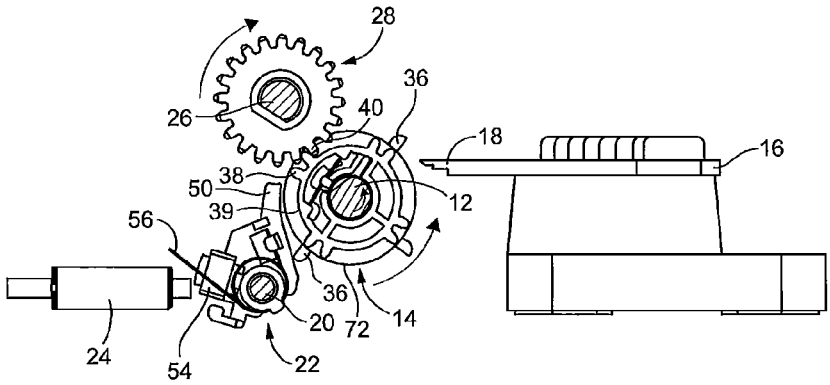
FIG. 11 is a schematic view of the mechanical performance unit when the protruding part is in sliding contact with the anchoring member according to one or more aspects of the disclosure.
Figure 12:
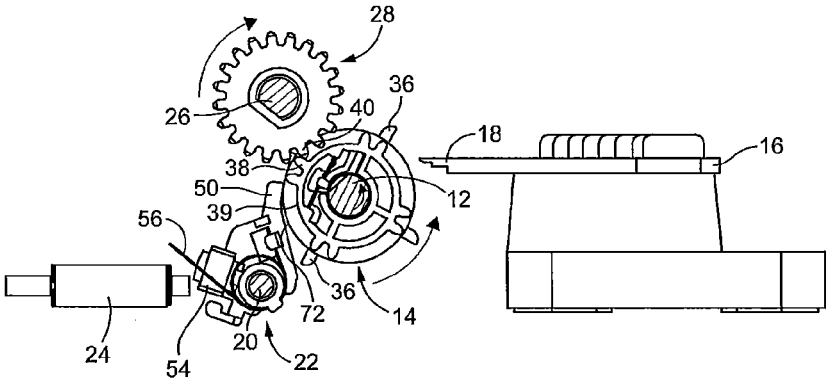
FIG. 12 is a schematic of the mechanical performance unit when the protruding part is in contact with an outer peripheral surface of the star wheel according to one or more aspects of the disclosure.

FIG. 9 illustrates the operations of the mechanical performance unit 100 for playing a sound by plucking the vibration valve 18 of the vibration plate 16 with the corresponding protruding part 36 on the star wheel 14. In this operation, the anchoring member 22 is set to its non-anchoring state, causing the plate member 50 to disengage from the protruding part 36. Subsequently, the star wheel 14 begins to follow the rotation of the first shaft 12 due to the frictional force generated at the area of contact between the first shaft 12 and the star wheel 14. When the star wheel 14 is near a phase in which one of the protruding parts 36 contacts the corresponding vibration valve 18 on the vibration plate 16, the corresponding gear teeth 38 adjacent to the protruding part 36 in the rotating direction (at a phase difference of 90 degrees in the rotating direction) are engaged with the gear teeth 40 on the sun wheel 28. In this state, the rotation of the sun wheel 28 drives the star wheel 14 in the direction of the arrow indicated in FIG. 9, i.e., in a direction for moving the protruding part 36 upward to pluck the vibration valve 18 on the vibration plate 16. In other words, the protruding part 36 of the star wheel 14 plucks the corresponding vibration valve 18 while the gear teeth 40 of the sun wheel 28 are engaged with the gear teeth 38 on the star wheel 14. Through this operation, a sound at the tone corresponding to the vibration valve 18 is played.

After the vibration valve 18 is plucked in this way, the star wheel 14 continues following the rotation of the first shaft 12 until the gear teeth 38 are no longer engaged with the gear teeth 40 on the sun wheel 28. Hence, the mechanical performance unit 100 returns from the state in FIG. 9 to the state in FIG. 6 through the state in FIGS. 10-12. That is, FIGS. 6 through 12 show the process in which the star wheel 14 begins rotating from the standby position (the state shown in FIG. 6) at which one protruding part 36 of the star wheel 14 is anchored by the anchoring member 22, plucks the corresponding vibration valve 18 once (the state shown in FIG. 9), and is once again halted in the standby position with the anchoring member 22 anchoring a subsequent protruding part 36 adjacent to the one protruding part 36, i.e., upstream side of the rotational direction of the star wheel 14.

Figure 14:
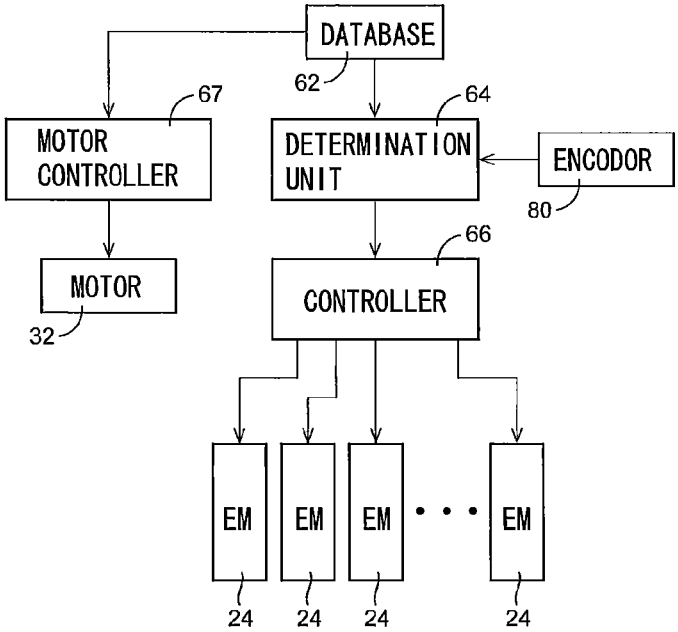
FIG. 14 is a block diagram of control functions of an electric control unit in the music box according to one or more aspects of the disclosure.

Next, the engaging and disengaging operations of the anchoring member 22 will be described with reference to FIG. 14. FIG. 14 is a block diagram showing the primary control functions possessed by the ECU 60. As shown in FIG. 14, the ECU 60 includes a musical score database 62, a release timing determination unit 64, and an electromagnet excitation control unit 66.

The musical score database 62 stores data for a plurality of musical scores corresponding to songs or melodies for the music box 10 to play. The musical score database 62 is stored on a storage medium, such as an SD card (Secure Digital card) well known in the art, and the ECU 60 is capable of reading the data stored on the storage medium. The musical scores may be stored in a data format such as MIDI (Musical Instrument Digital Interface) and may include a plurality of tracks (channels) for a predetermined plurality of instrument types, wherein the output timing, tone, and the like for sounds is specified for each instrument.

The musical score database 62 corresponds to a storage unit for storing melody data. The melody data stored in the musical score database 62 establishes a sound length for each sound from the moment the sound is played until the next sound is played. That is, the sound length corresponds to the length of time from the moment the vibration valve 18 on the vibration plate 16 is plucked by one protruding part 36 until the moment the next vibration valve 18 (the same or a different vibration valve 18) is plucked by the subsequent protruding part 36.

Sound lengths set in the melody data are represented by ticks, which are the smallest unit of time. Ticks are determined based on the tempo and time base (resolution) of the melody data. The length of one tick (in seconds) is obtained by dividing 60 by tempo value and by time base, for example. The length of a sixteenth note in melody data is preferably equivalent to 120 ticks. The shortest length of a sound in the melody data is preferably set to a length equivalent to one-third the length of a sixteenth note, which is 40 ticks in this example. When the same sound is played consecutively according to the melody data, the shortest sound length of the same sound played successively is set to a length equivalent to a sixteenth note in the melody data, i.e., 120 ticks in this example. As is described below in greater detail, the music box 10 according to the preferred embodiment controls a musical performance based on output timings and musical tones set in MIDI data, for example.

The release timing determination unit 64 determines a release timing at which each of the anchoring members 22 releases the engagement with the protruding part 36 of the corresponding star wheel 14. In other words, the release timing determination unit 64 determines the release timing for switching the excitation/non-excitation state of the electromagnet 24 corresponding to each of the anchoring members 22 (the timing at which electricity to the electromagnets 24 is conducted and halted).

For example, while the mechanical performance unit 100 is performing a melody corresponding to prescribed melody data for one of a plurality of melodies stored in the musical score database 62, the release timing determination unit 64 performs the above determinations based on the output timing and musical tone for each sound specified in the melody data. More specifically, the release timing determination unit 64 determines the release timing at which each anchoring member 22 releases the protruding part 36 of the corresponding star wheel 14 in order that the vibration valves 18 corresponding the various musical tones are plucked at the output timings set in the melody data.

When the rotations of the first shaft 12 and the second shaft 26 are set to constant speeds, a time lag indicating the amount of time that elapses after the anchoring member 22 releases the protruding part 36 of the corresponding star wheel 14 and until the protruding part 36 plucks the corresponding vibration valve 18 is determined in advance. The release timing determination unit 64 makes the release timing based on the melody data for the melody being played. The output timing for the musical tone corresponding to each vibration valve 18 is specified in the melody data. After switching the electromagnet 24 from the non-excitation state to the excitation state, the release timing determination unit 64 makes a determination to switch the electromagnet 24 back to the non-excitation state after a predetermined time has elapsed.

The electromagnet excitation control unit 66 switches the state of each electromagnet 24 between the excitation state and the non-excitation state based on the determination results of the release timing determination unit 64. In other words, the electromagnet excitation control unit 66 controls the timing at which electricity is conducted to, and not conducted to, each of the electromagnets 24 based on the determination results of the release timing determination unit 64. For example, when the release timing determination unit 64 has determined the release timing at which the anchoring member 22 releases the protruding part 36 of the corresponding star wheel 14, the electromagnet excitation control unit 66 switches the state of the corresponding electromagnet 24 from the non-excitation state to the excitation state based on this timing. Hence, the electromagnet excitation control unit 66 begins conducting electricity to the electromagnet 24 at this timing. After switching the electromagnet 24 from the non-excitation state to the excitation state, the electromagnet excitation control unit 66 preferably switches the electromagnet 24 back to the non-excitation state after a predetermined time has elapsed. Hence, the electromagnet excitation control unit 66 halts the conduction of electricity at this timing. After the electromagnet excitation control unit 66 halts the conduction of electricity to the electromagnet 24, a time of approximately 30 ms is required for the anchoring member 22 to return to a position for engaging one of the protruding parts 36 on the star wheel 14 (a position at which the anchoring member 22 contacts the circumferential surface 72 of the star wheel 14).

The motor controller 67 controls the rotational speed of the motor 32 and, hence, the speed at which the first shaft 12 and the second shaft 26 are rotated by the motor 32. Hence, when the music box 10 is performing a melody corresponding to prescribed melody data stored in the musical score database 62, the motor controller 67 controls the rotational speed of the motor 32 so that the first shaft 12 and the second shaft 26 are rotated at a speed based on the tempo set in the melody data. In other words, the first shaft 12 and the second shaft 26 are rotated at a speed based on the tempo at which the melody data is to be played. Thus, the motor controller 67 controls the motor 32 to rotate at a faster speed when the tempo set in the melody data is faster.

The motor controller 67 preferably drives the sun wheels 28 to rotate at a speed by which the interval between slits 84 detected by the encoder 80 is one-third the sound length of a sixteenth note in the melody data. In other words, the rotational speed of the sun wheel 28 is set such that the time period from when the encoder 80 detects the passage of one slit 84 to when the encoder 80 detects the passage of the next slit 84 is one-third the sound length of a sixteenth note in the melody data, and preferably so that the interval between slits 84 detected by the encoder 80 is 40 ticks (i.e., the shortest sound length), for example. That is, the rotational speed of the sun wheel 28 is set such that a sixteen note is equivalent to the time period while the encoder 80 detects the passage of three slits 84.

The release timing determination unit 64 preferably controls the release timing at which each anchoring member 22 releases the corresponding star wheel 14 based on the timing at which the encoder 80 detects passage of the slits 84. Specifically, since the rotating disk 82 of the encoder 80 is provided on the second shaft 26, which is the rotational shaft of the sun wheels 28, the release timing determination unit 64 can detect the positions of the tips of the gear teeth 40 on the sun wheels 28 and set the timing for starting rotation of the star wheel 14 by identifying the positions of the slits 84 formed in the rotating disk 82. The release timing determination unit 64 preferably controls the release timing at which each anchoring member 22 releases the corresponding star wheel 14 in accordance with the melody date based on: sound lengths set in the melody data; the tempo of the melody being played (corresponding to the rotational speed of the second shaft 26); and the amounts of rotation detected by the encoder 80.

The release timing determination unit 64 controls the release timing at which the anchoring members 22 disengage from the star wheels 14 based on the timing at which the encoder 80 detects the passing slits 84 so that the gear teeth 38 of the star wheel 14 engage precisely with the gear teeth 40 on the sun wheel 28. In other words, the release timing determination unit 64 ensures that the gear teeth 38 mesh precisely with the gear teeth 40 rather meeting tooth-against-tooth. To accomplish this, the release timing determination unit 64 controls the release timing when the encoder 80 detects the passing of at least one slit 84 after the output timing of a prescribed sound in the melody data has elapsed.

With the encoder 80 detecting passing of a prescribed slit 84 serving as the trigger to release the star wheel 14, the music box 10 according to the preferred embodiment sets conditions such as the rotational speeds of the first shaft 12 and the second shaft 26 and the relative positions of the star wheel 14 and the sun wheel 28 so that the gear teeth 38 on the star wheel 14 precisely mesh with the gear teeth 40 on the sun wheel 28. Through this control, the music box 10 can ensure that the gear teeth 38 on the star wheel 14 mesh smoothly with the gear teeth 40 on the sun wheel 28 rather than meeting tooth-against-tooth. Hence, the music box 10 can suitably reduce the chances of disjointed timing at which the protruding part 36 of the star wheel 14 plucks the corresponding vibration valve 18.

Further, the release timing determination unit 64 preferably controls the release timing in accordance with the tempo at which the melody data is to be played based on the length of sounds specified in the melody data, and the rotational amount of the sun wheel 28 detected by the encoder 80, thereby controlling the anchoring member 22 to release the star wheel 14. For example, the release timing determination unit 64 controls the release timing when the rotational amount detected by the encoder 80 is equivalent to 120 ticks (approximately 120 ms) specified in the melody data. If the mechanical performance unit 100 is playing a sound whose sound length specified in the melody data is 120 ticks, then the release timing determination unit 64 controls the anchoring member 22 to disengage from the star wheel 14 when the encoder 80 detects the passing of four slits 84 (when three slits 84 pass after the passing of a first slit 84 was detected).

Figure 17:
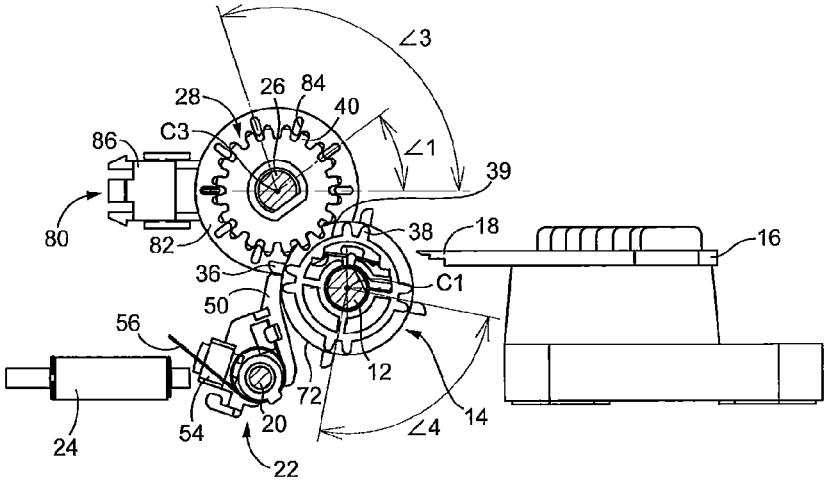
FIG. 17 is a schematic view of the mechanical performance unit when the anchoring member is in the anchoring state according to one or more aspects of the disclosure.

FIG. 17 illustrates the rotations of the star wheel 14 and the sun wheel 28 during an operation for plucking the vibration valve 18 one time. The star wheel 14 is halted by the plate member 50 at the standby position while the motor 32 continuously drives the second shaft 26. The time period while the star wheel 14 is brought into rotation upon the release of the anchor, plucks the corresponding vibration valve 18, and then is engaged with the plate member 50 once again is shorter than the time period corresponding to the sound length of the sound played according to the tempo designated in the melody data. This time period corresponding to the sound length is preferably equivalent to one sixteenth note, i.e., 120 ticks specified in the melody data, for example. As described above, when the same sound is to be played in succession, the shortest length of the sound played in succession (a sound played consecutively by the same vibration valve 18) is set to a length equivalent to a sixteenth note. Hence, when playing the same note in succession based on the melody data, the time period while the star wheel 14 is brought into rotation upon the release of the anchor, plucks the corresponding vibration valve 18, and then is engaged with the plate member 50 once again is shorter than the sound length corresponding to a sixteenth note.

As shown in FIG. 17, an angle ∠3 is defined among four slits 84 relative to the axial center C3 of the second shaft 26, i.e., the angle ∠3 is equivalent to 108 degrees. The time period from when the one protruding part 36 is released from the corresponding anchoring member 22 to when the subsequent protruding part 36 is anchored by the anchoring member 22 is shorter than the time required for the sun wheel 28 to rotate together with the second shaft 26 the angle ∠3. The angle ∠3 corresponds to a sound length played at the specified tempo. The sound length is preferably equivalent to a sixteenth note, i.e., 120 ticks specified in the melody data. Hence, the time required for rotating the sun wheel 28 at the angle ∠3 is equivalent to the time corresponding to 120 ticks in this example.

The star wheel 14 rotates the angle ∠4 during the time period from when the one protruding part 36 is released from the corresponding anchoring member 22 to when the subsequent protruding part 36 is anchored by the anchoring member 22, i.e., the angle ∠4 is formed between the one protruding part 36 and the subsequent protruding part 36 relative to the rotational center C1 of the first shaft 12. Specifically, the angle ∠4 is 90 degrees, for example, which is smaller than the angle ∠3. Since the intermittent gear on the star wheel 14 is large enough for twenty gear teeth, if gear teeth were provided in the toothless portions 39 as depicted in dotted line of FIG. 16, the angle ∠4 is equivalent to five gear teeth. Since the star wheel 14 and the sun wheel 28 are rotated at the same speed, as described earlier, if both wheels begin to rotate from their prescribed phases, the star wheel 14 will be returned to the standby position before the time equivalent to 120 ticks has elapsed. Because the angle ∠4 is smaller than the angle ∠3 and the angle ∠3 corresponds to 120 ticks, the star wheel 14 will be returned to the standby position before the 120 ticks has elapsed. That is, after the one protruding part 36 is disengaged from the anchoring member 22, the subsequent protruding part 36 adjacent to the one protruding part 36 that was just disengaged becomes anchored by the anchoring member 22 before the prescribed sound length (e.g., the time equivalent to 120 ticks) has elapsed.

Figure 18:
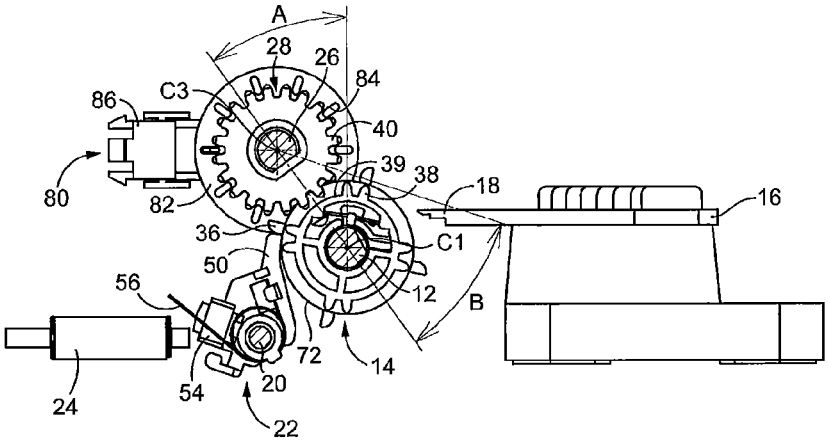
FIG. 18 is a schematic view of the mechanical performance unit when the anchoring member is in the anchoring state according to one or more aspects of the disclosure.

FIG. 18 is an explanatory diagram for describing the rotation amount of the star wheel 14 and the sun wheel 28 from when the star wheel 14 is released to when the protruding part 36 on the star wheel 14 strikes the vibration valve 18. The star wheel 14 is rotated by a rotation amount A (example of a first rotation angle) and the sun wheel 28 is rotated by a rotation amount B (example of a second rotation angle) during the time period from when the star wheel 14 is released to when the protruding part 36 plucks the vibration valve 18. In the music box 10 of the preferred embodiment, the rotational amount A of the star wheel 14 is equivalent to the rotational amount B of the sun wheel 28. Setting the rotational amount A of the star wheel 14 the same as the rotational amount B of the sun wheel 28 reduces imprecision in the timing at which tones are sounded. Here, provided that the star wheel 14 and the sun wheel 28 have a reduction ratio of 1:1, the star wheel 14 and the sun wheel 28 will rotate the same angular amount during the time period from when the ECU 60 controls the anchoring member 22 to release the star wheel 14, so that the star wheel 14 is brought into rotation about the first shaft 12 to when the gear teeth 38 on the intermittent gear of the star wheel 14 engage with the gear teeth 40 on the gear part of the sun wheel 28. The protruding part 36 on the star wheel 14 is plucking (contacting) the corresponding vibration valve 18 while the gear teeth 38 of the star wheel 14 are engaged with the gear teeth 40 of the sun wheel 28.

Next, a time lag between the plucking of one star wheel 14 and the plucking of another star wheel 14 different from the one star wheel 14 in the axial direction of the first shaft 12 will be described in detail. The shortest sound length is equivalent to one-third the sound length of a sixteenth note set in the melody data. When the encoder 80 detects that the sun wheel 28 has rotated an amount corresponding to this shortest sound length, the release timing determination unit 64 controls the anchoring member 22 to release the star wheel 14. Specifically, the release timing determination unit 64 controls the release timing based on a rotational amount detected by the encoder 80 that is equivalent to 40 ticks (approximately 40 ms) specified in the melody data. When the mechanical performance unit 100 is playing a sound whose sound length is specified as 40 ticks in the melody data, as shown in FIG. 15, the release timing determination unit 64 controls the release timing based on when the encoder 80 detects the passing of one slit 84 (i.e., the time elapsed after the encoder 80 detects the passing of one slit 84 until the next slit 84 passes). For example, as shown in FIG. 3, the release timing determination unit 64 controls the release timing such that the anchoring member 22*b* can release the star wheel 14*b*, after the anchoring member 22*a* releases the star wheel 14*a* and a prescribed time corresponding to 40 ticks has elapsed.

The ECU 60 controls the release timing at which each anchoring member 22 releases the corresponding star wheel 14 so that the shortest time interval at which different vibration valves 18 can be plucked in succession is equivalent to the time required for the rotating disk 82 to rotate the angle ∠1, which is the angle between two neighboring slits 84. As described earlier, the motor controller 67 drives the sun wheel 28 to rotate at a speed such that the encoder 80 will detect the interval between neighboring slits 84 to be 40 ticks. Therefore, the time required to rotate the rotating disk 82 the angle ∠1 between neighboring slits 84 is equivalent to 40 ticks. Thus, the ECU 60 controls the release timing such that the shortest time interval at which a plurality of different vibration valves 18 can be plucked in succession is equivalent to 40 ticks specified in the melody data. Accordingly, the quickest that the music box 10 can strike different vibration valves 18 in succession is every 40 ticks. In other words, the music box 10 of the preferred embodiment can pluck a vibration valve 18 of the same tone at a resolution of 120 ticks and vibration valves 18 of different tones at a resolution of 40 ticks.

The magnetic member of the anchoring member 22 in the preferred embodiment may be configured of a permanent magnet. When the electromagnet 24 is in the excitation state, the magnetic force of the electromagnet 24 causes the permanent magnet to rotate the anchoring member 22 in the first rotating direction. The permanent magnet is preferably formed in the synthetic resin member 54, which is integrally provided with the plate member 50, through insert molding, and is preferably positioned to produce a repelling force (force of repulsion between like magnetic poles) with the electromagnet 24 when the electromagnet 24 is excited. The magnetic force of the electromagnet 24, i.e., the force of repulsion produced between the electromagnet 24 and the permanent magnet, moves the plate member 50 of the anchoring member 22 against the urging force of the torsion coil spring 56. Accordingly, the anchoring member 22 rotates about the third shaft 20 in a direction away from the star wheel 14 (the first rotating direction), thereby disengaging the plate member 50 from the protruding part 36 and placing the anchoring member 22 in its non-anchoring state.

While the disclosure has been described in detail with reference to specific embodiments thereof, it would be apparent to those skilled in the art that many modifications and variations may be made therein without departing from the spirit of the disclosure, the scope of which is defined by the attached claims.

In short, the disclosure is not limited to the structure described above with reference to FIGS. 1 through 18. For example, the number of protruding parts 36 provided on each star wheel 14 is not limited to four and need not be arranged at 90-degree intervals around the periphery thereof. Further, the gear teeth 38 need not be provided at positions corresponding to the protruding parts 36 and may be positioned at different phases around the periphery of the star wheel 14.

Further, the electromagnets 24 and the anchoring members 22 belonging to the first group and the electromagnets 24 and the anchoring members 22 belonging to the second group need not be disposed at 90-degree intervals in a circumferential direction around the axial center of the first shaft 12. For example, all electromagnets 24 may be juxtaposed along the same plane. Conversely, if five or more of the protruding parts 36 were provided around the periphery of the star wheel 14, for example, pluralities of the electromagnets 24 and anchoring members 22 could be arranged at positions corresponding to three or more phases spaced at prescribed phase differences in a circumferential direction around the axial center of the first shaft 12, depending on the number of protruding parts 36 provided. Further, two or more of the anchoring members 22 may be provided for each star wheel 14 as the mechanism for anchoring the star wheel 14.

The ECU 60 may also be connected to the Internet or another communication link and may be configured to download musical score data via the communication link and store this data in the musical score database 62.

In addition, the shape of the star wheel 14, structure of the anchoring member 22 (shape of the plate member 50), phase positions of the various components, and the like may be modified as needed to suit the design of the music box. For example, the gear teeth 38 need not be provided in pairs, but may be provided in groups of one or three or more, provided that the sun wheel 28 can drive the star wheel 14 a sufficient distance and time interval for allowing the protruding part 36 to pluck the corresponding vibration valve 18 of the vibration plate 16. Further, the shortest sound length specified in the melody data provided in the musical score database for the same sound played in succession need not be 120 ticks. Similarly, the shortest sound length for different sounds is not limited to 40 ticks.

What is claimed is:

1. A music box comprising:

a plurality of star wheels configured to rotate about a first axis, each of the plurality of star wheels comprising:

a plurality of protruding parts protruding outward in a radial direction of each of the plurality of star wheels; and an intermitting gear configured to rotate about the first axis, the intermitting gear comprising a plurality of gear teeth extending outward in a radial direction of the intermitting gear;

a plurality of sun wheels corresponding to the plurality of star wheels and arrayed along a second axis extending parallel to the first axis, the plurality of sun wheels being fixed on the second axis and configured to rotate about the second axis, each of the plurality of sun wheels comprising a plurality of gear portions, at least one of the plurality of gear portions being configured to engage at least one of the plurality of gear teeth;

a drive unit configured to drive the first axis and the second axis;

a plurality of anchoring members corresponding to the plurality of star wheels, each of the plurality of anchoring members being configured to engage one of the plurality of protruding parts;

a plurality of vibration valves arrayed along a first direction extending parallel to the first axis, and corresponding to the plurality of star wheels, each of the plurality of vibration valves being configured to be plucked by one of the plurality of protruding parts;

a rotating disk configured to rotate according to a rotation of the second axis, the rotating disk being formed with a plurality of slits arrayed in a circumferential direction of the rotating disk;

a detection unit configured to detect a passage of one or more of the plurality of slits; and a control unit configured to control one or more of the plurality of anchoring members to disengage one of the plurality of protruding parts of one or more of the plurality of star wheels corresponding to the one or more of the plurality of anchoring members, based on a detection result of the detection unit.

2. The music box according to claim 1, wherein the control unit controls one or more of the plurality of anchoring members to disengage corresponding one of the plurality of protruding parts upon detecting a passage of a predetermined number of slit by the detection unit.

3. The music box according to claim 2, wherein the plurality of slits is arrayed at prescribed intervals in the circumferential direction, wherein the detection unit detects the passage of the number of slits during a minimum time period from a plucking of one of the plurality of vibration valves by one of the plurality of protruding parts to a sequential plucking of another of the plurality of vibration valves by another protruding part, after one of the plurality of anchoring members disengages corresponding one of the plurality of protruding parts, wherein the control unit controls one or more of the plurality of anchoring members to disengage corresponding one of the plurality of protruding parts based on detecting a passage of a predetermined number of slit by the detection unit.

4. The music box according to claim 1, wherein the plurality of slits is arrayed at prescribed intervals in the circumferential direction, wherein the control unit controls one or more of the plurality of anchoring members to disengage corresponding one of the plurality of protruding parts such that, after one of the plurality of anchoring members disengages corresponding one of the plurality of protruding parts, a time period from a plucking of one of the plurality of vibration valves by one of the plurality of protruding parts to a sequential plucking of another of the plurality of vibration valves by another of the plurality of protruding parts is longer than a time period while the detection unit detects a passage of two slits.

5. The music box according to claim 1, wherein the intermitting gear has a first number of the plurality of gear teeth, the intermitting gear including an intermitting part which has no gear tooth in a circumferential direction of the intermitting gear, wherein each of the plurality of the sun wheels has a second number of gear teeth, wherein the second number of gear teeth is an integer multiple of the first number, wherein the drive unit configured to drive the first axis and the second axis at a rotational speed, wherein a first rotation angle defines that one of the plurality of star wheels rotates by the drive unit from a first time when the one or more of the plurality of anchoring members disengage one of the plurality of protruding parts of one or more of the plurality star wheels corresponding to the one or more or the plurality of anchoring members to a second time at least one of the plurality of gear teeth engages at least one of the plurality of gear portions, wherein a second rotation angle defines that one of the plurality of sun wheels rotates by the drive unit from the first time when the one or more of the plurality of anchoring members disengage one of the plurality of protruding parts of one or more of the plurality star wheels corresponding to the one or more or the plurality of anchoring members to the second time at least one of the plurality of gear teeth engages at least one of the plurality of gear portions, wherein the first rotation angle is equal to the second rotation angle.

6. The music box according to claim 1, wherein the plurality of slits is formed at a position corresponding to the plurality of gear portions, wherein each of the plurality of sun wheels has a number of the plurality of gear portions, wherein the rotating disk has a number of the plurality of slits, wherein the number of the plurality of gear portions is an integer multiple of the number of the plurality of slits.

7. The music box according to claim 1, wherein the control unit controls the drive unit to determine a rotational speed of the first axis and the second axis based on playing speed of playing sound according to a musical data stored in a memory.

8. The music box according to claim 1, wherein the control unit controls the plurality of anchoring members based on a musical data stored in a memory.

* * * * *